US005442888A

United States Patent [19]

Ilnyckyj

[11] Patent Number: 5,442,888

[45] Date of Patent: Aug. 22, 1995

[54] SHINGLES

[76] Inventor: Peter Ilnyckyj, 185 Rosewell Ave., Toronto, Ontario, Canada

[21] Appl. No.: 158,533

[22] Filed: Nov. 29, 1993

Related U.S. Application Data

[63] Continuation of Ser. No. 986,936, Dec. 8, 1992, abandoned.

[51] Int. Cl.[6] ..... E04D 1/00

[52] U.S. Cl. ..... 52/524; 52/527; 52/533; 52/539

[58] Field of Search ..... 52/518, 523, 524, 525, 52/526, 528, 543, 545, 549, 551, 556, 527, 530, 531, 532, 533, 535, 539

[56] References Cited

U.S. PATENT DOCUMENTS

| | | | |
|---|---|---|---|
| 349,966 | 9/1886 | Wightman . | |
| 406,024 | 1/1896 | Crawford . | |
| 5,535,141 | 1/1896 | Crawford . | |
| 1,431,103 | 10/1922 | Donahue . | |
| 1,496,336 | 2/1922 | Ennis . | |
| 1,529,530 | 3/1922 | Wyatt . | |
| 1,570,516 | 1/1926 | Miller . | |
| 1,653,085 | 12/1927 | Buckley . | |
| 1,688,612 | 10/1928 | Clow . | |
| 2,133,363 | 10/1938 | Talmage | 108/17 |
| 2,167,192 | 7/1939 | Weber | 108/17 |
| 2,187,139 | 1/1940 | Rowe | 108/8 |
| 2,248,336 | 7/1941 | Bussey | 108/17 |
| 2,598,497 | 5/1952 | Brown et al. | 108/7 |
| 2,830,546 | 4/1958 | Rippe | 108/17 |
| 2,882,840 | 4/1959 | Waske . | |
| 3,209,506 | 10/1965 | Waske . | |
| 3,473,274 | 10/1969 | Godes | 52/543 |
| 3,605,369 | 9/1971 | Merrill et al. | 52/530 |
| 4,218,857 | 8/1980 | Vallee . | |
| 4,788,808 | 12/1988 | Slocum | 52/543 X |

*Primary Examiner*—Carl D. Friedman
*Assistant Examiner*—Kien T. Nguyen
*Attorney, Agent, or Firm*—Kenneth M. Garrett

[57] ABSTRACT

A roofing shingle is conveniently formed from a square sheet metal blank. One corner of the blank is provided with a pair of open ended, back to back U shaped slots transverse to a diagonal passing through that corner. The two sides intersected by the slots are downwardly turned to form a small margin, and the other two sides are upwardly turned to form a margin of similar width to the downwardly turned sides. The corner is also downwardly folded above the slots to form a margin of similar width to the other margins, and below the slots it is folded so as to be generally parallel to the central area of the shingle. A shingle support preferably of foamed sheet polystyrene is disposed on the under surface of the shingle. The shingles are layed course by course on a pitched roof in a diamond configuration, a shingle of an upper course engaging the respective downturned edges of two adjacent shingles of a lower course in the U shaped slots to lock the lower corner of the upper shingle mechanically in position. Nails or screws may be used to secure portions of the upper shingle remote from the mechanically locked corner. A downwardly turned side of the upper shingle and an upwardly turned side of a lower shingle will form a seal to resist the penetration of driven rain and capillary action. The shingled roof has an appearance of thickness, while heat transference between shingles is generally reduced in comparison to flat shingles.

29 Claims, 3 Drawing Sheets

SHINGLES

This application is a continuation in part of application serial no. 986,936 filed Dec. 8, 1992, now abandoned.

FIELD OF INVENTION

This invention relates to roofing shingles. It particularly relates to shingles of high durability that are simply constructed from sheet metal and that are easily installed.

BACKGROUND OF INVENTION

It has previously been proposed to form shingles from asphalt squares wherein the shingle is provided with a pair of slots adjacent one corner which permits corner portions of a shingle from an upper course of shingles to engage beneath edge portions of an adjacent pair of shingles of a lower course, so mechanically locking that corner portion of the upper shingle to the lower shingles. However, due to the resiliency of asphalt shingles, the mechanical interlock is insufficient to provide a good weather seal between shingles. Moreover, the slotting of asphalt shingles adjacent to areas that are relatively highly stressed can lead to premature failure of the shingle.

Metal roofing shingles are well known in the art. Many of the prior proposals relate to providing mechanical interlocks between adjacent shingles layed on the same course and/or between shingles of adjacent courses, which interlocks are formed by relatively tightly overturning margins of the shingles along their length, to form channels having a hooked cross section, mid hooking the margins of adjacent shingles together. It is found that capillary action can lead to leakage.

One of the disadvantages of metal shingles arises from their high thermal conductivity. Although in many of the prior art proposals the overturned margins of the shingles provided for interlocking purposes will serve to raise the central areas of the shingle from the underlaying roof structure and to create a small air space, this is generally insufficient for insulating proposes. It is also insufficient to permit heating cables or the like to be located under the shingles.

Another disadvantage of metal shingles of the raised type is that central areas thereof are not well supported whereby they tend to be permanently deformed under only moderately heavy loads.

Yet mother disadvantage, particularly in those types wherein the edges are folded under so as to be linkable with another shingle in side by side relationship is that it is difficult to conform these shingles to irregularities in the supporting roof structure.

It is an object of this invention to provide metal roofing shingles having a simple interlock provision.

It is a further object of this invention to provide such shingles which provide good mechanical sealing capability, while minimizing the possibility of leakage due to capillary action.

A still further object of this invention is to provide metal roofing shingles of increased load beating capacity.

It is yet another object of this invention to provide metal roofing shingles that minimize the metal to metal contact area between shingles while being maintained in substantially spaced apart relation from underlaying shingles and roof structure so as to provide increased insulation capability, and also to permit heating cables or the like to locate beneath the shingles.

It is yet another object of this invention to provide metal roofing shingles that are amenable to being deformed in an intentional manner while being layed so as to overcome small irregularities in the underlaying roof structure.

It is still another object of this invention to provide metal roofing shingles which provide an attractive appearance of thickness so as to give a distinctive sculptured look when the shingles are installed on a roof.

SUMMARY OF THE INVENTION

In accordance with one aspect of my invention, a roofing shingle has a periphery therearound defining a generally planar central area. The periphery comprises a first margin portion extending along approximately one half of the periphery and a second margin portion extending along the remainder of the periphery. The first margin portion is downwardly turned, to define two opposed ends, preferably the edge of the first margin portion being outwardly upset to form a narrow skirt which resides in a plane which is suitably parallel to that of the central area and spaced apart therefrom by the width of the first margin portion, which will preferably be constant therealong. A notional diagonal bisects the first and second margin portions to intersect them respectively at first and second zones. Generally speaking, the shingles will be symmetrical on opposed sides of this diagonal. A connector depends from the first margin portion adjacent the first of the zones. In accordance with the preferred embodiment, the connector comprises a head portion residing in a plane generally parallel to that of the central area and spaced therebelow by a distance equal to about twice the width of the first margin portion by a tongue portion which connects the head portion to the first margin portion. The head portion has a width greater than that of the tongue portion so as to form therewith two hook elements which will hook the connector beneath the downturned margins of two other adjacent shingles forming part of a lower course of shingles on a roof or wall. Many other forms of lock connectors are known in the art, however, and under some circumstances may be preferred.

The shingle preferably includes a shingle support means which is disposed on the undersurface of the central area, and which is suitably in the form of sheet expanded foam plastic such as polystyrene. The thickness of the shingle support means diminishes uniformly as measured along the diagonal in a direction away from the connector such that when the shingle is layed in a position of repose on a planar surface, the central area adjacent the second zone and the edges adjacent each end of the first margin portion will be proximate the planar surface, and the first zone of the central area will be spaced thereabove by about twice the width of the first margin portion.

The use of the shingle support means where of a foamed plastic material serves to increase the insulating capacity of the shingle, and permits a load which will depend on the structural density of the foam material to be applied to the shingles without their undergoing permanent deformation.

The central area will normally be provided with at least three openings adjacent the second margin portion for the passage of fasteners such as nails or screws which secure the shingle to a roof or wall. Two of these openings will reside adjacent the respective ends of the second margin portions, being spaced apart therefrom by a distance which is somewhat greater than the overlap recommended with an adjacent shingle of a higher course. The shingle support means will desirably underlay these two openings so as to act as a spacer to impede the deformation of adjacent portions of the central area when the fasteners are driven into position. The third opening will normally be disposed in the second zone, close to the second margin, and accordingly, it will locate on a portion of the central area which will be in close proximity to an underlaying surface supporting the shingle; as a consequence of this, the shingle will not require to be supported in the vicinity of the third opening, and the shingle support means need not extend into the second zone.

Suitably, the second margin portion is upwardly turned and has a related width to that of the first margin portion whereby the edge of the second margin portion forms a seal with adjacent shingles of an overlaying course of shingles. Preferably both the first and second margin portions will have a similar and constant width therealong, so that the edges reside in planes parallel to the plane of the central area.

By the terms "downwardly" and "upwardly" turned, it is intended to mean that the first and second margin portions respectively are not overturned to any substantial degree so as to form a channel-like structure in which the margin overlays or underlays the central area of the shingle. Generally speaking, it is preferred that the margins are upturned and downturned respectively through an angle of somewhat less than 90°, so that they are slightly outwardly splayed. This permits the shingles to be fitted more easily over small irregularities in the underlaying roof structure by simply applying a pressure on the central area that will vary the angle at which the margins are splayed in a controlled manner, rather than crushing the margins. The preferred foam plastic material of the shingle support means permits localized deformation which also facilitates the fitting of shingles over small irregularities while providing a good load bearing capability.

In accordance with a preferred aspect of my invention, the roofing shingle has five sides bounding the planar central area, four of which sides are generally orthogonally related. The margins of a first pair of the four sides intersect the fifth side, and together with the margin of the fifth side form the first margin portion. The margin of the remaining two of the four sides from the second margin portion, and the connector of the shingle depends from the fifth side.

The shingles are layed course by course on a roof in a diamond configuration. An overlaying shingle makes contact with underlaying shingles essentially along the edges of the upturned and downturned margins and along heels formed by the juncture of the central area with the upturned margins, so minimizing thermal flow paths between shingles.

Suitably, the shingle support means will be spaced apart from the first margin portion so as to permit a suitable overlap between shingles of adjacent courses, which will leave an air space within which may be layed heat pipes for the purpose both of collecting thermal energy and also for melting snow and ice, or heating cables. Generally speaking, it will be preferred that the shingle support means extends in a substantially continuous manner and that it covers not less than about 70% of the bottom surface of the central area.

The edge contact between shingles of different courses minimizes heat transfer between shingles and also reduces the possibility of leakage due to capillary action. The preferred shingles of the invention provide two seals which restrict the upward passage of driving rain and snow beneath the shingles. The first, outer seal is formed by the downwardly turned margins of the upper shingle which bear on the central planar areas of lower shingles, and the second seal is formed by the upwardly turned margins of the lower shingles which bear on the underside of the central planar area of the upper shingle. The two seals are separated by overlapping parts of the shingles, between which are located means such as nails or screws as indicated earlier, that serve to secure the shingles to the roof structure. The shingle support means, where this comprises sheet foam plastic material, will also assist in providing a seal between shingles of adjacent courses.

In accordance with the preferred embodiment, the downwardly turned margins are outwardly turned along their edges to form a skin, one purpose of which is to prevent the raw edge of the margins, which may be relatively sharp, from marring the finish of the shingles. Preferably this skirt will be vestigial, which is to say of a width little more than the thickness of the metal, commensurate with the ease of upsetting the margin to form the skirt. Such skirt will also tend to increase the effectiveness of the first seal provided by the downturned margins without conducing to any significant disadvantage arising from capillary attraction or heat transference between shingles.

Suitably and preferably, the preferred five sided shingle of the invention is formed from a square blank, with small off cuts adjacent one corner serving to form the fifth side and a connector unitary therewith.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
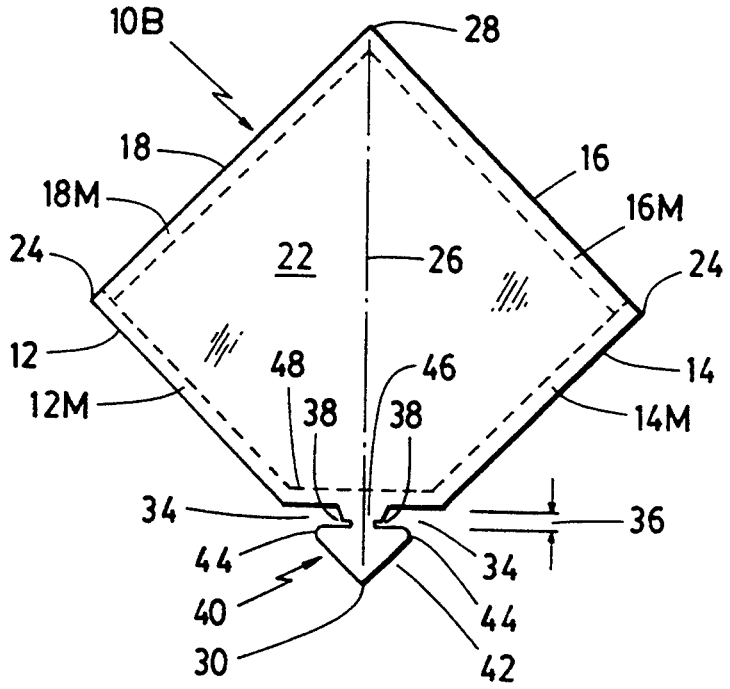
FIG. 1—shows in plan form a partially formed blank from which shingles of the invention are formed, with construction lines shown in dashed outline.

Referring to the drawings in detail, a blank suitable for forming a roofing shingle in accordance with the invention is identified in FIG. 1 by the numeral 10B. Blank 10B is generally square in planform, and includes four orthogonally related sides 12, 14, 16, 18 each of which has a margin, respectively shown as 12M, 14M, 16M, 18M, bounding a planar central area 22. A pair of comers 24, an apex corner 28 and a lower corner 30 are identified to facilitate further description. A notional diagonal 26 extends between corners 28, 30 to bisect blank 10B. A pair of back to back notches 34 open at one end are cut adjacent to corner 30 on a geometric axis transverse to diagonal 26. The notches have a depth 36, and width which is marginally increased at slots 38, and form a connector 40 which comprises a head portion 42 having a pair of hook elements 44 and a tongue portion 46 which connects medial portions of head portion 42 to superior portions of blank 10B.

Figure 2:
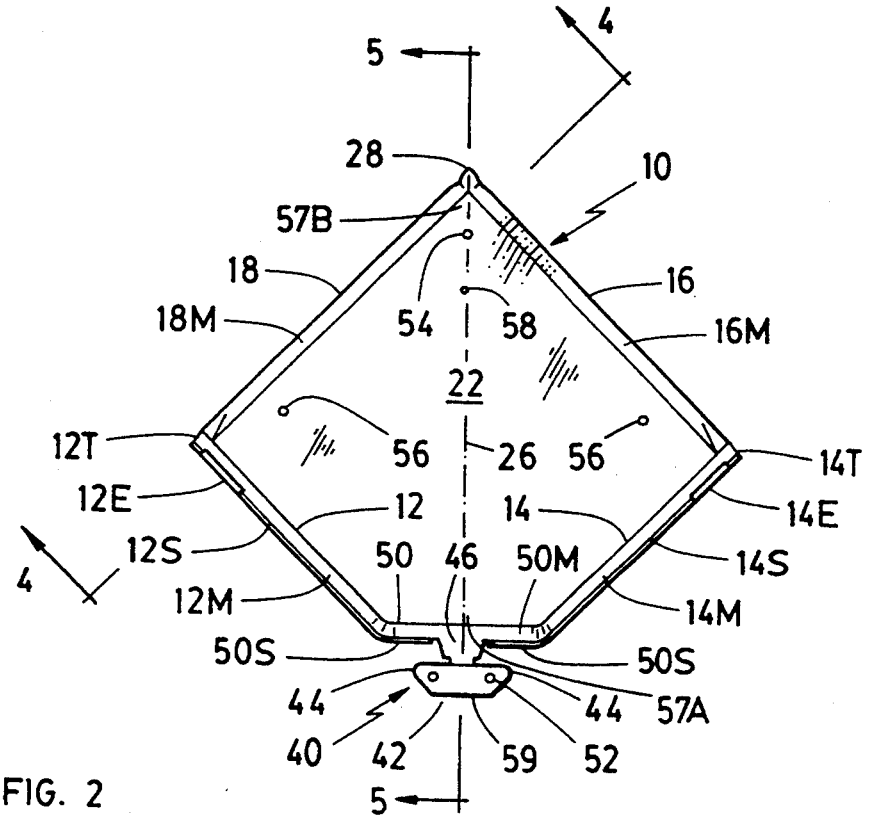
FIG. 2—shows in perspective view a shingle formed from the blank of FIG. 1.
Figure 3:
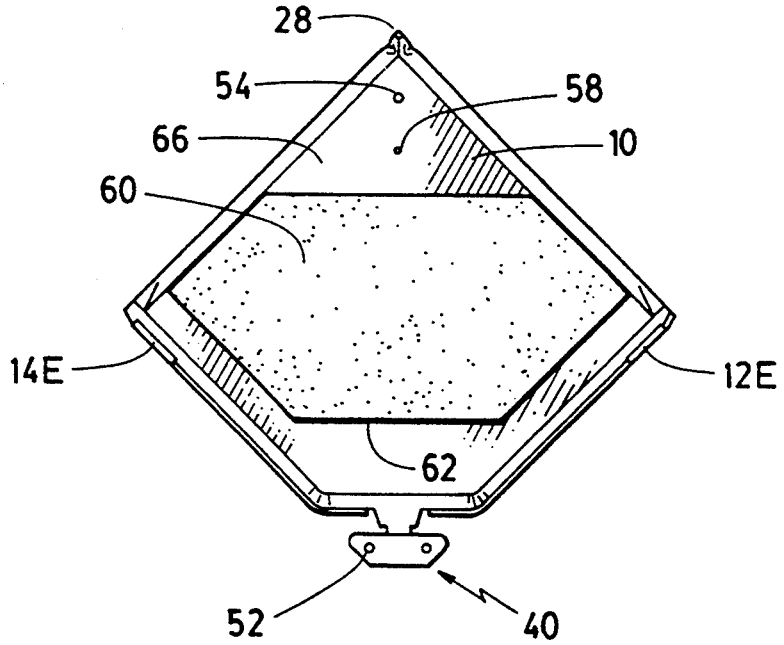
FIG. 3—is a plan view from below the shingle of FIG. 2.
Figure 4:
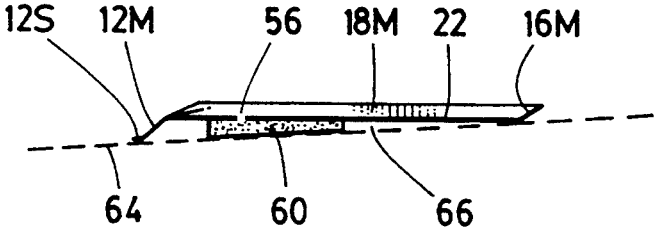
FIGS. 4 and 5 are cross-sections on lines 4—4 and 5—5 respectively of FIG. 2.
Figure 5:
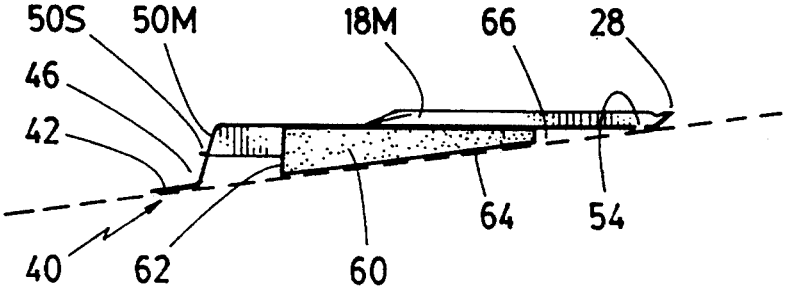

Shingle 10, as seen in FIG. 2, is formed by upsetting blank 10B to bend margin 16M and 18M upwardly through an angle of somewhat less than a right angle to the plane of central area 22, and similarly to bend margins 12M and 14M downwardly therealong to adjacent notches 34, which downward bending is continued along a line 48 transversely to diagonal 26 and spaced apart from the upper edge defining notches 34 by a distance equal to the width 20 of margins 12M, 18M, in effect forming a fifth side 50 to shingle 10, and a corresponding margin 50M. The free edges of each of margins 12M, 14M and 50M are outwardly turned to form a vestigial skirt 12S, 14S and 50S, which skirts are coplanar along the major part of their length, but which are slightly raised to form an enhance 12E, 14E adjacent the terminal ends 12T, 14T of the downturned margins. Blank 10B is further upset to bend head portion 42 of connector 40 into a plane generally parallel to that of central area 22, and to form small glides 52 on the underside of the head portion. The upsetting operation still further includes piercing central area 22 on diagonal 26 adjacent to apex 28 to form a first simple opening 54, and a pair of simple openings 56, the location of which is subsequently referred to in greater detail. A small alignment dimple 58 is formed on central area 22 on diagonal 26 spaced inwardly from opening 54 by a distance related to the desired overlap between shingles, as will be further described. Finally, lower corner 30 is clipped at 59 for aesthetic purposes. For reference purposes, it is useful to identify the point of intersection of notional diagonal 26 with the downwardly turned margins 12M, 14M and 50 at a first zone 57A and with upturned margins 16M, 18M at a second zone 57B, and it will be understood from the foregoing description that these zones will locate at mid-point along their associated margin portions.

Figure 7:
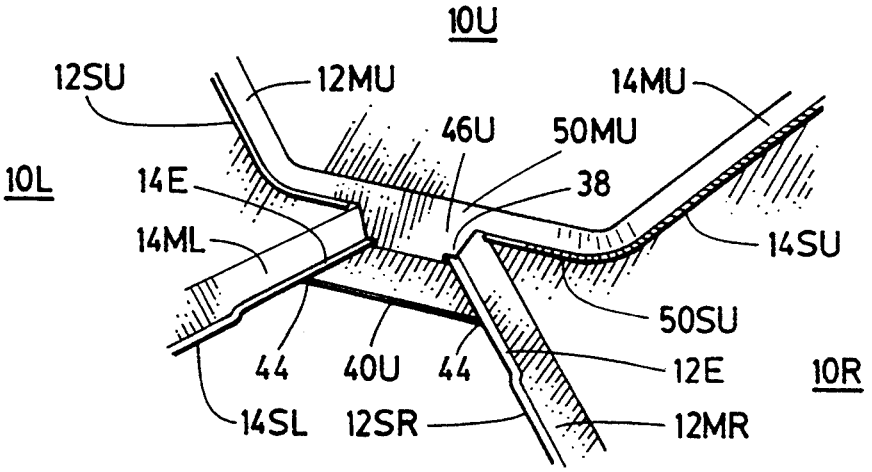

A shingle support 60 comprising a sheet of foamed polystyrene plastic is adhered to the underside of central area 22. The lower edge 62 of shingle support 60 is disposed in spaced apart relationship with the downturned margins 12M, 14M and 50M by a distance marginally greater than the desired overlap between adjacent courses of shingles, as will be subsequently referred to. Shingle support 60 extends to adjacent each upturned margin 16M, 18M to underlay openings 56. The thickness of shingle support 60 diminishes uniformity along diagonal 26 towards apex 28 and parallel to the diagonal such that when shingle 10 supported on a plane surface 64, the central area 22 adjacent apex 28 and skin 12S, 14S adjacent the ends 12T, 14T of the downturned margins will be proximate the plane surface, and the skirt 50S of margin 50M will be spaced apart from the plane surface by a distance which is sufficient to permit the downturned margin of an underlaying shingle 10 to be engaged beneath the skirt, as best seen in FIG. 7. In this embodiment, where the downturned margins 12M, 14M, 50M have a uniform width therealong, the distance from which skirt 50S is spaced apart from plane surface 64 by shingle support 60 will be approximately equal to the width of the margins. In the event that shingles 10 are constructed from heavy gauge metal a small allowance may be made for this, but for most practical purposes metal thickness may be discounted. The spacing from planar surface 64 of upper portions 66 of central area 22 may be only some 2 to 3 mm, and as a practical matter it is found not to be necessary for shingle support 60 to underlay area 66.

Figure 6:
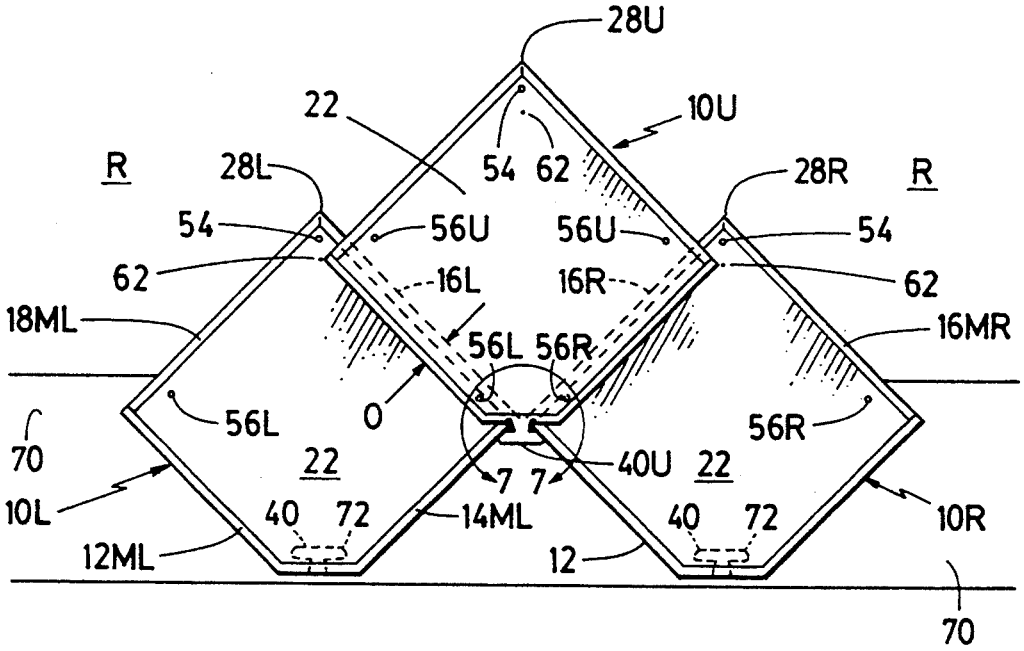
FIG. 6—shows in plan view the shingles of the invention laid on a roof, with hidden detail shown in dashed outline, and FIG. 7—is a segment 7—7 of FIG. 6 on an enlarged scale, in perspective view.

In using shingles 10, these will normally locate on a roof with apex 28 uppermost and diagonal 26 residing on the fall line of the roof. The placement of three such shingles 10 is illustrated in FIG. 6 wherein the component elements of the shingles are differentiated where necessary by the letters L (left), R (right) and U (upper). The shingles 10 are layed in courses, one above the other. Assuming shingles 10L and 10R to be layed as part of a starter course, and ignoring for the moment some special requirements associated with that course, shingles 10L, 10R are secured to a roof R conveniently by means of screws (not shown), which pass through openings 54, 56 with a corner 24R contiguous to a corner 24L. The pair of hook elements 44 of upper shingle 10U are then respectively engaged in the entrances 12E, 14E and hooked beneath the margins 14ML and 12MR of the first course of shingles. Glides 52 facilitate the movement of the head portion 42 of shingle 10M over the surface of the underlaying shingles 10L, 1 OR and reduce the incidence of scratching. Shingle 10U is pulled upwardly until the lateral skirts 12S and 14S engage in slots 38 of tongue 46U (FIG. 7); comers 24U are adjusted so as to be coincident with alignment dimples 58L, 58R. It will be apparent that the width of tongue 46 will tend to control the overlap 0 between shingles of adjacent courses and that the lower edge 62 of shingle support 60 should be spaced from downturned margins 12M, 14M and 50M by a distance adequate to permit such overlap. It will also be apparent that the depth 36 of notches 34 will be such as to permit the passage of the downturned margins 14ML and 12MR along the notches as shingle 10U is pulled upwardly. Generally speaking, depth 36 will be equal to the width 20 of the downturned margins 12M, 14M, so as to provide a tight fit between the courses of shingles. As a corollary of this, head portion 42 of connector 40 will, at the juncture thereof with tongue portion 46, be spaced apart from the plane of central area by a distance approximately equal to twice the width of the margins. Finally, shingle 10U is secured to the roof by screws (not shown) through openings 54, 56 in that shingle.

It will be appreciated from the foregoing that shingle 10U will be supported from underlaying shingles 10L, 10R by shingle support 60. Metal contact between the shingles may be limited to be little more than edge contact, which may be little more than the thickness of the sheet metal from which the shingles are constructed, thereby reducing the thermal conductivity between shingles.

It will further be appreciated that the edge contact will essentially avoid the possibility of capillary action drawing moisture upwardly between shingle courses. It will also be noted that edges of downturned margins of upper shingle 10U will provide a first seal where they bear against the outwardly facing central area of lower course shingles 10L, 10R, and also that the edges of upturned margins 16L, 18R of the lower course of shingles will provide a second seal where they bear against the undersurface of shingle 10U.

To lay a starter course of shingles 10, a starter strip 70 is first secured to roof R to extend upwardly thereon to a distance not less than approximately equal to half the diagonal dimension of a shingle. With apex 28 pointing downwardly and shingle 10 face down, connector 40 is secured m the roof at 72 by screw or any other convenient means, and shingle 10 is then rotated through 180° by bending tongue 46 along the lower edge of margin 50M, thereby in effect concealing connector 40 of the starter course beneath the shingle.

It will be apparent that many changes may be made to the illustrative embodiment while falling within the scope of the invention, and it is intended that all such changes be covered by the claims appended hereto.

I claim:

1. A shingle having a periphery therearound defining a central area residing generally in a plane;

said periphery comprising a first margin portion extending along approximately one half of said periphery and a second margin portion extending along the remainder thereof;

said first margin portion being downwardly turned to terminate at two opposed ends and form an edge therealong which resides generally in a plane, a notional diagonal generally intersecting said first and second margin portions respectively at first and second zones disposed proximate the mid-point of said margin portions;

shingle support means depending from said central area for supporting said shingle when placed on a planar support surface whereby said central area adjacent said second zone and each edge adjacent said ends is proximate such planar support surface, and whereby said central area adjacent said first zone is spaced above such planar support surface by a distance approximately equal to twice the width of said margin portion adjacent said first zone, and a connector including a hook element disposed beneath the plane of said central area adjacent said first zone;

wherein said shingle support means is continuously spaced apart from said first margin portion therearound to leave an open gap therebetween.

2. A shingle as defined in claim 1 wherein said second margin portion is upwardly turned whereby edge portions thereof reside in a plane.

3. A shingle as defined in claim 2 wherein the plane in which said edge portions of said first and second margin portions reside are generally parallel to the plane of said central area.

4. A shingle as defined in claim 1 wherein said first margin portion is downturned at an angle of less than 90° so as to be outwardly splayed.

5. A shingle as defined in claim 4 wherein said first margin portion is upset along the edge thereof to form a skirt.

6. A shingle as defined in claim 5 wherein said skirt is outwardly turned.

7. A shingle as defined in claim 1 wherein said connector comprises a tongue portion downwardly depending from said first margin portion and a head portion extending laterally outwardly from said tongue portion and inclined with respect thereto to define therewith a pair of said hook elements.

8. A shingle as defined in claim 7 wherein said head portion is provided with a pair of slots respectively disposed for receiving a skirt of each of a pair of underlaying shingles therein when said shingle is disposed in overlaying course relationship with such pair of underlaying shingles.

9. A shingle as defined in claim 8 wherein said skin is raised marginally adjacent each said end to facilitate the passage of a hook element thereunder.

10. A shingle as defined in claim 7 wherein said connector is unitarily formed with said first margin portion.

11. A shingle as defined in claim 7 wherein said head portion is provided with at least one downwardly depressed area to form a glide.

12. A shingle as defined in claim 1 wherein said central portion is provided with an aligmnent guide thereon.

13. A shingle as defined in claim 1 wherein said central area is provided with a plurality of openings therethrough adjacent said second margin portion for securing said shingle to a roof.

14. A shingle as defined in claim 1 wherein said shingle is five sided.

15. A shingle as defined in claim 14 wherein four of said sides are orthogonally related, and wherein said connector connects to the fifth side.

16. A shingle as defined in claim 1 wherein said shingle support means extends in a substantially continuous manner and covers not less than about 70% of the bottom surface of said central area.

17. A shingle as defined in claim 16 wherein said shingle support means is expanded polystyrene sheet.

18. A shingle having a periphery therearound defining a central area residing generally in a plane, said periphery comprising a first margin portion extending along approximately one half of said periphery and a second margin portion extending along the remainder thereof;

said first margin portion being downwardly turned at an angle of less than 90° so as to be outwardly splayed with respect to said central area to terminate at two opposed ends, and form an edge therealong which resides generally in a plane;

a notional diagonal generally bisecting said first and second margin portions respectively at first and second zones, and a connector disposed beneath the plane of said central area adjacent said first zone;

said connector comprising a tongue portion downwardly depending from said first margin portion and a head portion extending laterally outwardly from said tongue portion and inclined with respect thereto to define therewith a pair of hook elements.

19. A shingle as defined in claim 18 wherein said second margin portion is upturned whereby edge portions thereof reside in a plane.

20. A shingle as defined in claim 18 wherein the plane in which said edge portions of said first and second margins reside are generally parallel to the plane of said central area.

21. A shingle as defined in claim 18 wherein said first margin portion is upset along the edge thereof to form a skirt.

22. A shingle as defined in claim 18 wherein said skirt is outwardly turned.

23. A shingle as defined in claim 22 wherein said head portion is provided with a pair of slots respectively disposed for receiving a skirt therein when said shingle is disposed on overlaying course relationship with a pair of underlaying shingles.

24. A shingle as defined in claim 18, including shingle support means depending from said central area to support said shingle when placed on a planar surface whereby said central area adjacent said second zone and each said edge adjacent said ends is proximate said planar surface, and said central area adjacent said second zone is spaced above said planar surface by a dimension approximately equal to twice the width of said margin portion adjacent said first zone.

25. A shingle as defined in claim 24 wherein said shingle support means extends in a substantially continuous manner and covers not less than about 70% of the bottom surface of said central area.

26. A shingle as defined in claim 24 wherein said shingle support means is expanded polystyrene sheet.

27. A shingle as defined in claim 24 wherein said shingle support means is continuously spaced apart from said first margin portion to leave an open gap therebetween.

28. A shingle having a periphery therearound defining a central area;

said periphery including a first margin portion extending approximately along one half of said periphery downwardly turned to terminate at two opposed ends and form an edge therealong which resides generally in a plane; and a second upturned margin portion extending generally along the remainder of said periphery; and form an edge which resides generally in a plane;

a notional diagonal generally bisecting said first and second margin portions respectively at first and second zones;

an insulating shingle support means depending from said central area for supporting said shingle when placed on a planar support surface whereby said central area adjacent said second zone and each edge adjacent said opposed ends is proximate such planar support surface and whereby said central area adjacent said first zone is spaced above such planar support surface;

said shingle support means being spaced apart from said first margin portion therearound to have a continuous gap therebetween;

a connector downwardly depending from said first margin portion adjacent said first zone, comprising a tongue portion projecting between said edge and a head portion projecting from said tongue portion to form therewith a pair of hooks.

29. A shingle having a periphery therearound defining a central area residing generally in a plane, said periphery comprising a first margin portion extending along approximately one half of said periphery and a second margin portion extending along the remainder thereof;

said first margin portion being downwardly turned to terminate at two opposed ends, and form an edge therealong which resides generally in a plane;

a notional diagonal generally bisecting said first and second margin portions respectively at first and second zones, and a connector disposed beneath the plane of said central area adjacent said first zone;

said connector comprising a tongue portion downwardly depending from said first margin portion and a head portion extending laterally outwardly from said tongue portion and inclined with respect thereto to define therewith a pair of hook elements;

wherein said first margin portion is upset along said edge to form a skirt.

* * * * *